US005782128A

United States Patent [19]

Barjesteh et al.

[11] Patent Number: 5,782,128

[45] Date of Patent: Jul. 21, 1998

[54] HAND TOOL FOR FLARING A TUBE

[75] Inventors: Mike Barjesteh; Jerry Umbro, both of Randolph; Ali M. Sadegh, Closter, all of N.J.

[73] Assignee: Mastercool, Inc., Randolph, N.J.

[21] Appl. No.: 839,943

[22] Filed: Apr. 18, 1997

[51] Int. Cl.[6] ..... B21D 19/00

[52] U.S. Cl. ..... 72/318; 72/453.16; 72/481.2; 72/370.1

[58] Field of Search ..... 72/318, 453.16, 72/453.15, 481.2, 482.93, 316, 370.03, 370.1, 370.19, 370.22, 317; 29/237

[56] References Cited

U.S. PATENT DOCUMENTS

| | | | |
|---|---|---|---|
| 2,277,410 | 3/1942 | Neukirch . | |
| 2,493,127 | 1/1950 | Franck . | |
| 2,709,474 | 5/1955 | Franck . | |
| 2,869,407 | 1/1959 | Swanson | 72/453.16 |
| 3,466,707 | 9/1969 | Click . | |
| 3,972,218 | 8/1976 | Pawloski | 72/453.16 |
| 4,331,019 | 5/1982 | Smith | 72/453.15 |
| 4,494,398 | 1/1985 | Svoboda | 72/453.16 |
| 4,873,755 | 10/1989 | Johnston | 72/318 |

FOREIGN PATENT DOCUMENTS

| | | | |
|---|---|---|---|
| 658992 | 3/1963 | Canada | 72/317 |

*Primary Examiner*—Daniel C. Crane
*Attorney, Agent, or Firm*—Richard A. Joel, Esq

[57] ABSTRACT

A manually operable hand tool apparatus for providing a radially outward flare, known as push connect flare, away from the distal end of a deformable tube. The hand tool comprises a gripper-die means for securing the tube, a yoke portion having internal threads and a manual hydraulic pump portion. The yoke moves axially on a threaded positioning screw that is rigidly connected to the manual hydraulic pump portion. A vise means comprising a screw and a tightening rod is attached to the yoke. The vise is used to secure the gripper-die means to the yoke. The pump portion comprises a cylindrical body, a flaring piston, a threaded positioning screw, a pumping linkage system and a relief valve. An adapter-die is secured by a guide nut which is connected to the flaring piston. Alternative adapter-die and guide nut designs are also used to connect the die to the flaring piston. A lever arm is used to pump oil and to energize the flaring piston, thereby forcing the adapter-die to deform the rigidly restrained tube into the outward radial flair.

11 Claims, 9 Drawing Sheets

HAND TOOL FOR FLARING A TUBE

BACKGROUND OF THE INVENTION

1. Field of Invention

This invention relates to manually operable, portable, hydraulically powered, flaring hand tools and in particular to flaring tools for providing a radially convex outward flare, known as a push connect flare, a short distance from the distal end of a tube or a conduit.

2. Description of the prior art

Conventional fittings, adapters or couplers have been used for connecting a malleable cylindrical conduit to a tube, a hose, a fitting or another conduit. One of the methods of connection is by flaring the tube. There are many approaches to flaring a tube that relate to plastically deforming the distal end of the tube or a region a short distance from the distal end.

In surveying the prior art, conventional flaring apparatus are disclosed wherein a flaring cone is urged into the distal end of the tube, as illustrated in U.S. Pat. Nos. 4,068,515 granted to Kowal, et. al. on Jan. 17, 1978 and 4,779,441 granted to Pringle on Oct. 25, 1988. Other U.S. Pat. Nos. 4,127,021, 4,590,785, 4,716,752, 5,355,722, 5,228,323, 5,243,845, 5,355,722 and 5,382,151 were also cited. In general, these patents are related to apparatus for forming a flare of different shapes and forms on an end of a hollow malleable cylindrical conduit. The shape of the flared end is contoured accurately to conform to the seating surface of the fitting to which the flared tube is to be connected.

In many other applications, such as connecting a conduit to a hose, it is desirable to have a radially outward flare away from the end of the tube, known as a push connect flare. When used with a clamp, this type of flaring would seal the fluid inside the tube. None of the cited patents provide a hydraulically powered portable hand tool that creates a push connect flare in a section of a tube that is away from the distal end.

In view of the foregoing, there exists a need for a versatile hand tool that could be used as a repair tool for tubes that are attached to, or part of, a larger machine. Therefore, the objective of this invention is to provide a portable hand tool for creating a radially outward flare away from the end of the tube.

It is a further object of the invention to provide a manually powered hydraulic pump for this tool that will be used as a repair apparatus for connecting a fluid line to a hose or a different conduit.

SUMMARY OF THE INVENTION

This invention relates to a manually operable hand tool which provides a particular radially outward convex flare, known as a push connect flare, away from the distal end of a deformable tube. The invention comprises a yoke portion having internal threads at its end and which can move axially on a threaded positioning screw that is fixed to a manual hydraulic pump portion by two set screws. Rotation of the yoke portion relative to the pump embodiment brings the two units axially closer or farther apart relative to one another. The yoke portion comprises two gripper-dies, a back plate, a vise screw and a tightening bar. The tube is secured between the two gripper-dies. The back plate supports the gripper-dies. The tightening bar and the vise screw secure the tube and the gripper-dies within the yoke.

The pump portion comprises a cylindrical body, a flaring piston, a threaded positioning screw and a pumping unit. The cylindrical body has an oil reservoir located in the rear end of the body and a pressurized cylinder located in the front of the body. The positioning screw is a long hollow cylinder having threads on its outer surface and is rigidly connected to the cylindrical body. A flaring piston is located in the pressurized cylinder; it has an axially elongated body that extends through the positioning screw. The pumping unit comprises a lever arm, a linkage set, a spring and a piston which forces the fluid to flow from the oil reservoir to the pressurized front chamber of the cylinder. The pumping unit also has a relief valve unit that allows the fluid to return to the reservoir, thereby returning the piston to its initial position. A guide nut is placed at the end of the flaring piston that has an opening side into which the adapter-die, is placed and is secured relative to the piston by a snap ring.

In a first embodiment the tube is placed between the two gripper-dies where the distal end of the tube meets the end plane of the gripper-dies. The assembled gripper-die unit is placed in the space provided within the yoke that is also supported by the back plates. The gripper-die unit is secured and fixed by turning the tightening bar clockwise, thereby applying the thrust force from the vise screw to the side of the gripper-die unit.

For a specific size of tube an appropriate adapter-die is selected. The adapter-die has a cylindrical opening in its frontal end and a cylindrical step notch on its rear end. The adapter-die is dropped into the opening side of the guide nut such that the flat end of the adapter-die is securely in contact with the end of the piston. The pump unit is turned clockwise so that the tube enters into the frontal cavity of the adapter-die. When the force required for turning becomes excessive, the hydraulic pump is used. The hydraulic pump is activated by pushing the lever arm handle down; the action of the pump extends the flaring piston and pushes the adapter into the gripper-die. Since one end of the tube is fixed by the gripper-die and the distal end of the tube is constrained by the adapter-die all the axial force will be concentrated in an opening region between the gripper-die and the adapter-die. The tube will finally deform to a radially outward convex bubble shape in the space provided. The flared tube is retrieved by turning the release valve counter-clockwise and loosening the vise screw.

An alternative design of the adapter-die and the guide nut is also available wherein the alternate adapter-die has a threaded surface at its rear end and the alternate guide nut is a circular member having internal threads on its bore. The two alternates are engaged by screwing the end of the adapter-die into the guide nut. The alternate guide nut, in a manner similar to the original design, is connected to the end of the flaring piston by a snap spring.

The hand tool structure of the present invention is extremely simple and could be used in any location, including on site repair of fluid lines, without detaching the tube from its connection to field equipment, which gives an economical advantage to this invention.

BRIEF DESCRIPTION OF THE DRAWINGS

The above and other objects and advantages of this invention may be more clearly seen when viewed in conjunction with the accompanying drawings wherein.

DETAILED DESCRIPTION OF THE INVENTION

Figure 1:
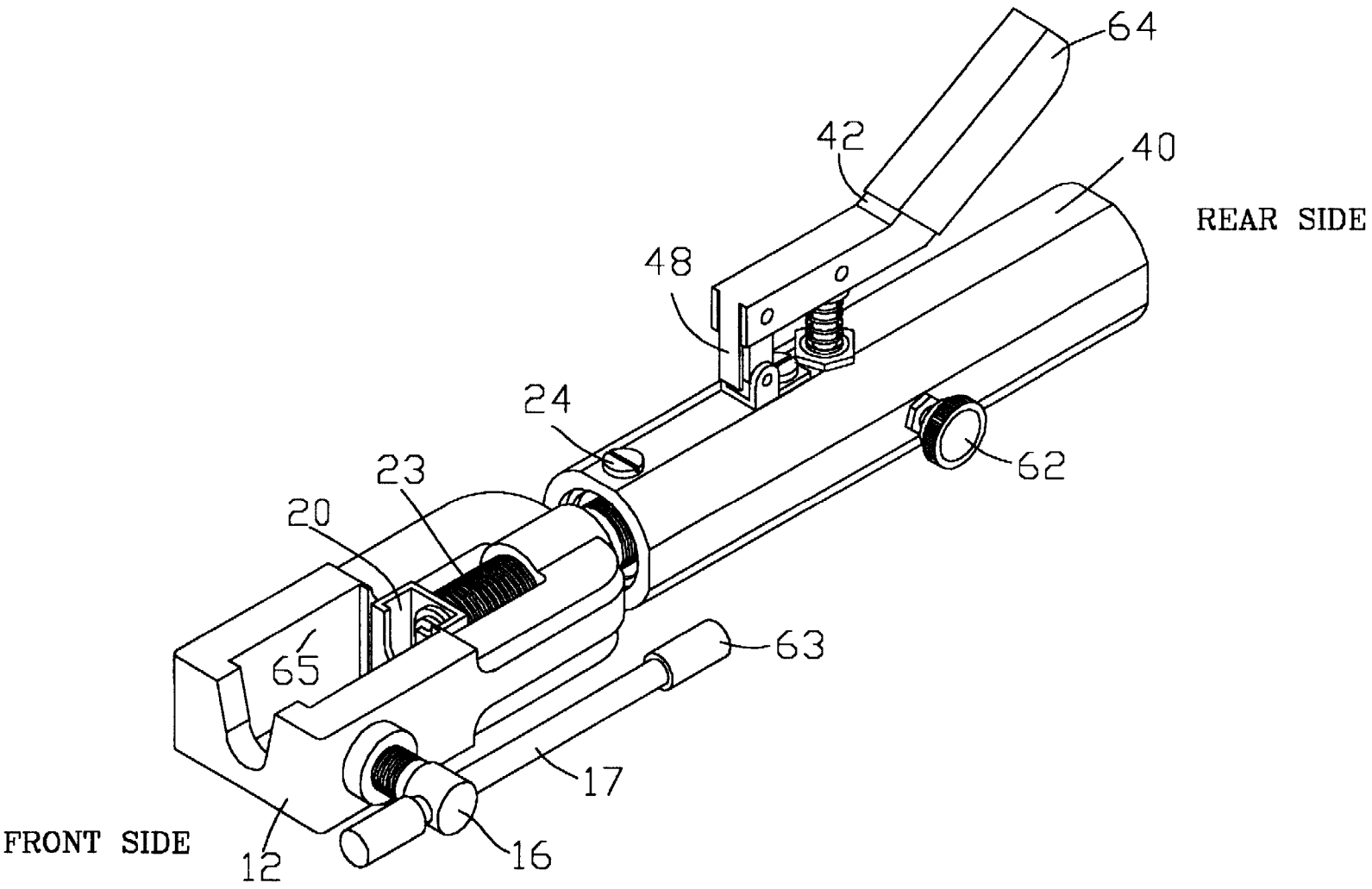
FIG. 1 is a perspective view of a hand tool push connect flaring apparatus without the gripper-dies and the adapter-die.

Referring now to the drawings the exemplary embodiment of the invention as disclosed in FIG. 1–13 illustrates the hand tool push connect flaring apparatus 10 in accordance with the teachings of the present invention. The frontal side of all embodiments described in this invention refers to the left side of FIG. 1 and the rear side of all members refers to the right side of FIG.1.

Figure 2A:
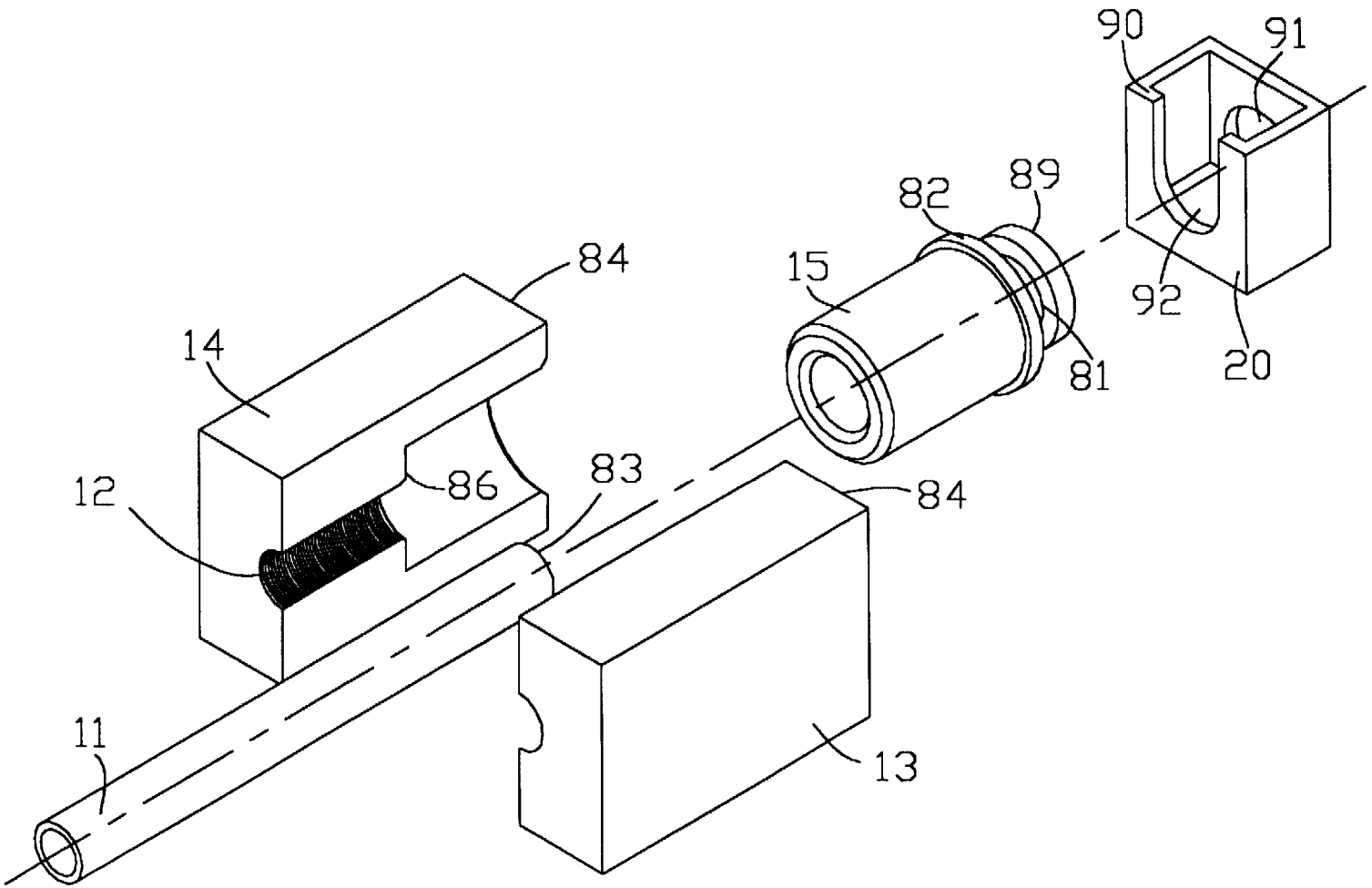
FIG. 2*a* is a perspective view of the tube, the gripper-dies and the adapter-die that are position within the yoke of FIG. 1.
Figure 2B:
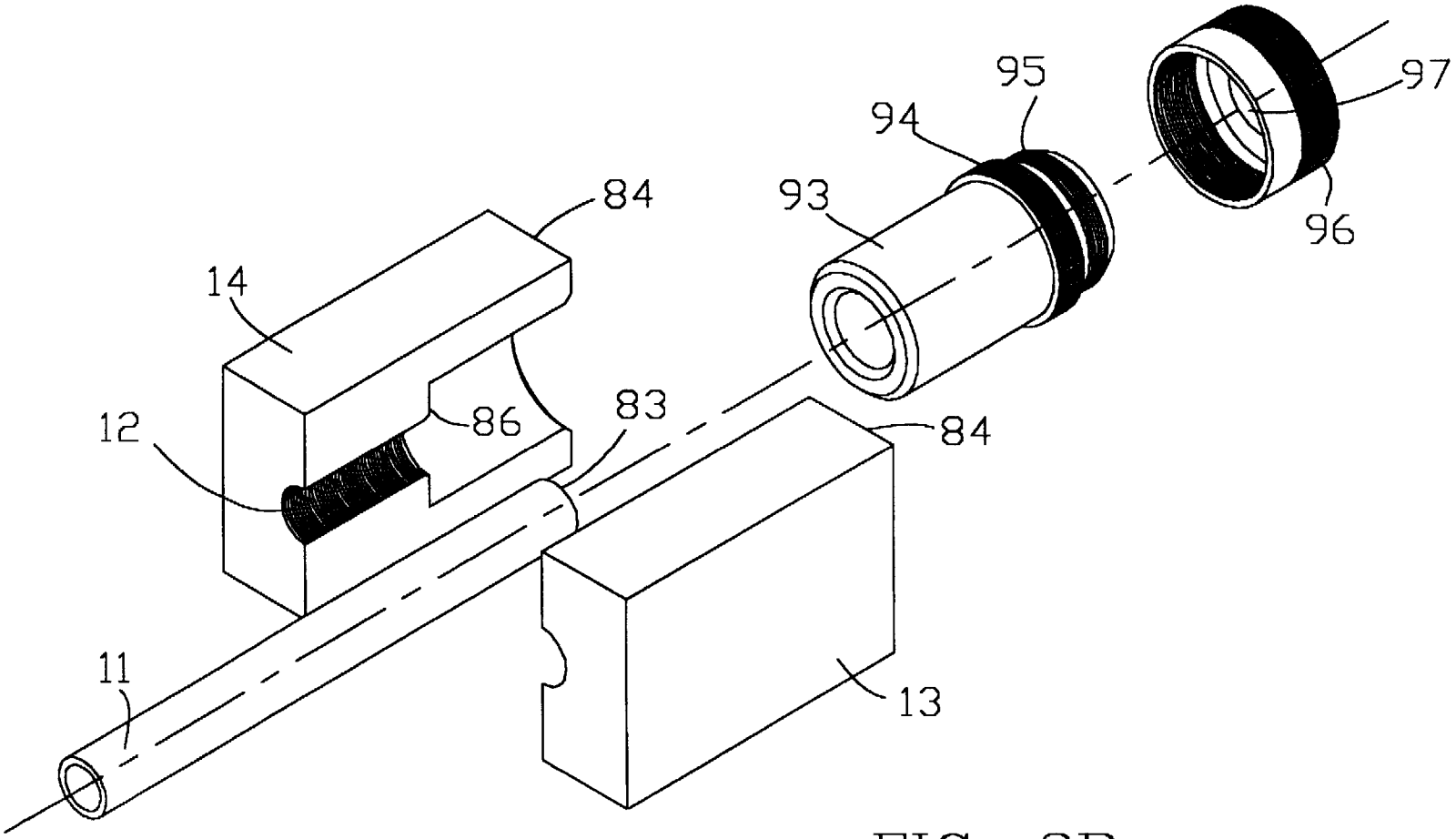
FIG. 2*b* is a perspective view of the tube, an gripper-dies and the alternative adapter-die that are positioned within the yoke of FIG. 1.
Figure 3:
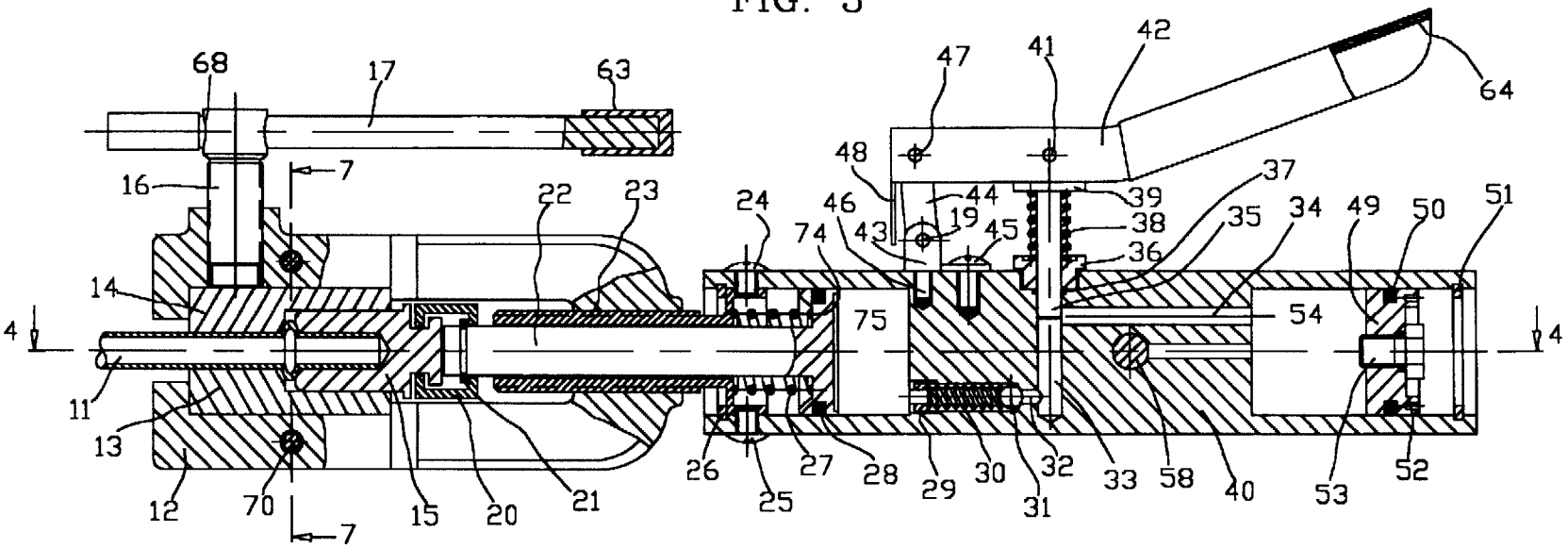
FIG. 3 is a cross-sectional view of the hand tool push connect flaring apparatus as shown in FIG. 1 taken along the line 3—3 of FIG. 1.

Referring to FIGS. 1–3 the apparatus 10 has generally a yoke 12 and a hydraulic pump portion 40. The yoke portion 12 contains tube 11 that is restrained by gripper-dies 13 and 14 and is secured to yoke 12 by vise screw 16 and tightening bar 17. The tips of tightening bar 17 are covered by soft plastic material 63 for ease of use and to prevent bar 17 from sliding out of hole 68. The distal end of the tube 11 is placed inside the cylindrical hole in the frontal end of adapter-die 15. There are two designs of the rear end of adapter-die 15. The primary design of the rear end of adapter-die 15 is shown in FIG.2a which contains circular step 82, a circular notch with rectangular cross-sectioned neck 81 and a circular end 89. Guide nut 20 that is associated with the primary design has a substantially cubic box structure 90, one side of which is open. The frontal side of 90 has a U-shaped opening 92 and its rear side has a closed circular opening 91. Flaring piston 22, see FIG. 3, is loosely connected to guide nut 20 through hole 90 and snap ring 21. That is, flaring piston 22 and guide nut 20 can be rotated independently and have relative axial movement with respect to one another. Adapter-die 15 is secured to flaring piston 22 by placing 15 into the opening side of guide nut 20 in which circular end 89 is placed inside of guide nut 20 such that U-Shaped opening 92 is placed within the steps of neck 81. In this position adapter-die 15 is secured to flaring piston 22 only in the axial direction.

From the open side of the guide nut 20, adapter-die 15 can easily drop into the nut 20 or removed out of the nut 20 which make this design attractive for the ease of replacement of the adapter-die 15. However, in some applications more secure attachment of the adapter-die 15 to the guide nut 20 is needed. An alternative design of the adapter-die 15 and the guide nut 20 is shown in FIG. 2*b*. Alternative adapter-die 93 has exactly the same tubular frontal end as 15 while its rear end has step ring 94 that is knurled for ease turning and externally threaded surface 95. Alternative guide nut 96 is a small thin cylindrical member having knurled outer surface and a circular hole 97 on its closed rear end and is threaded on its interior surface. In an alternative apparatus flaring piston 22 is loosely connected to guide nut 96 through hole 97 and snap ring 21. That is, flaring piston 22 and guide nut 96 can be rotated independently and have relative axial movement with respect to one another. Alternative adapter-die 93 is secured to flaring piston 22 by screwing 95 into the internal surface threads of guide nut 96.

Figure 12:
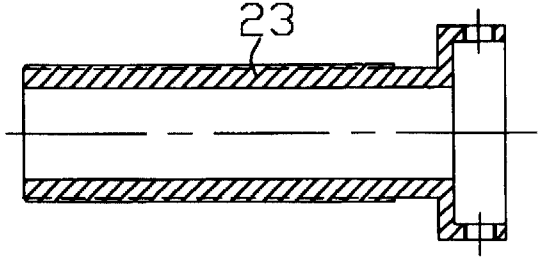
FIG. 12 is a cross-sectional view of a positioning screw of the hand tool push connect flaring apparatus as shown in FIG. 1; and, FIG. 13 is the cross-sectional view of a flaring piston of the hand tool push connect flaring apparatus as shown in FIG. 1.
Figure 13:
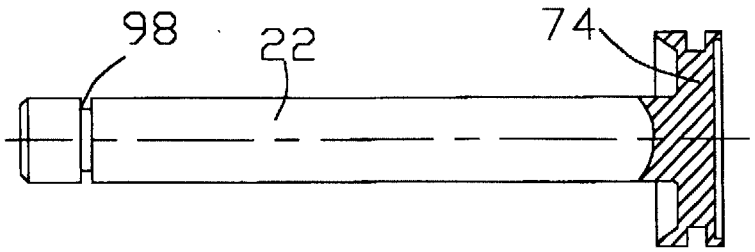

Hydraulic pump embodiment 40 consists of positioning screw 23 that is a cylindrical tube having its outer surface threaded, as shown in FIG. 12. As further shown in FIG. 2, positioning screw 23 is fixed to the body of 40 by two set screws 24 and 25, and is secured axially by snap ring 26. Flaring piston 22 is a solid cylindrical rod having circular notch 98 at its distal end and piston member 74 that is a larger diameter disc at the other end, as shown in FIG. 13. Circular disk 74 has O-ring 28 and is placed in frontal pressurized cylinder 75. Spring 27 applies a bias compression force to flaring piston 22 and disk 74 that is partially counteracting the oil pressure in the pressurized cylinder region 75.

Figure 11:
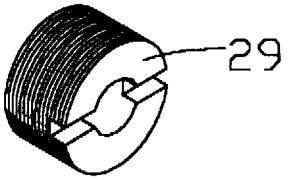
FIG. 11 is a perspective view of a set screw for securing the spring of the one way valve of the hand tool push connect flaring apparatus as shown in FIG. 1.

Hydraulic pump 40 also has cylindrical passages 32, 33 and 34 that connect oil reservoir 54 to frontal pressurized cylinder 75. Spring 30 compresses the spherical ball 31 against the opening of passage 32. The diameter of the opening of passage 32 is smaller than the diameter of ball 31 thus the compressive force of spring 30 keeps ball 30 at the opening of passage 32 thereby closing the opening. Set screw 29 adjusts the compressive force of spring 30 to ball 31. To increase the compressive load of spring 30, set screw 29 can be rotated clockwise using a screw driver as shown in FIG. 11. Hydraulic pump 40 has a pumping linkage system consisting of piston 35, lever arm 42, linkage bar 44 and support bracket 43. The oil is pumped from the reservoir 54 to 75 by piston 35 and lever arm 42. Piston 35 is secured in passage 33 by cap screw 36 and is sealed by O-ring 37. Spring 38 applies an upwardly compressive force to lever arm 42 through washer 39. The compressive force of spring 38 keeps lever arm 42 and hydraulic pump 40 separated and connects passages 34 and 33 by moving piston 35 upwardly. Lever arm 42 is hinged to linkage bar 44 by pin 47. Linkage bar 44 is hinged to support bracket 43 by pin 19. Support bracket 43 is rigidly attached to hydraulic pump 40 by screws 45 and 46, thus the whole pumping linkage system is stabilized. Stopper bar 48 that is attached to lever arm 42 limits the separation of lever arm 42 and hydraulic body 40.

Figure 10:
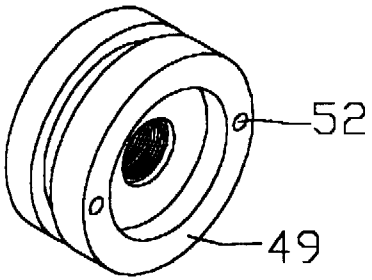
FIG. 10 is a perspective view of a oil reservoir piston of the hand tool push connect flaring apparatus as shown in FIG. 1.

As further illustrated in FIG. 2, oil reservoir 54 is located in the rear embodiment of hydraulic pump 40 and is closed by reservoir piston 49. O-ring 50 prevents oil leakage from the reservoir while snap ring 51 limits and restrains axially rearward movement of reservoir piston 49. To add or drain the oil in reservoir 54 screw 53 is provided. Reservoir piston 49 has two holes 52, as shown in FIG. 10. To open or close screw 53 for adding or draining the oil, two holes 52 are used to prevent reservoir piston 49 from rotation.

In a free position of lever arm 42, spring 38 applies compressive force to washer 39 and pushes lever arm 42 away from hydraulic pump 40. The compressive force is counteracted by the contacts that stopper 48 makes with support bracket 43. This is an upper limit position of lever arm 42. In this case, piston 35 is in its most upwardly position thereby connecting oil passages 33 and 34 to oil reservoir 54. By pressing lever arm 42 downward towards hydraulic pump 40, spring 38 is compressed, piston 35 is pushed downward through cylindrical passage 33, thereby pressurizing the oil that is in passages 33 and 32. The pressure in passage 32 pushes spherical ball 31 away from the opening of passage 32, thus forcing the oil to flow to frontal piston region 75. Once the oil has pressurized cylinder 75, spring 30 applies the bias force to ball 31 and closes the opening of passage 32 and thus prevents the reverse flow of the oil from region 75 to reservoir 54. Therefore, after a few strokes of lever arm 42, region 75 is pressurized and through disk 74, flaring piston 22 applies an axially compressive force to adapter-die 15 that flares tube 11.

Figure 4:
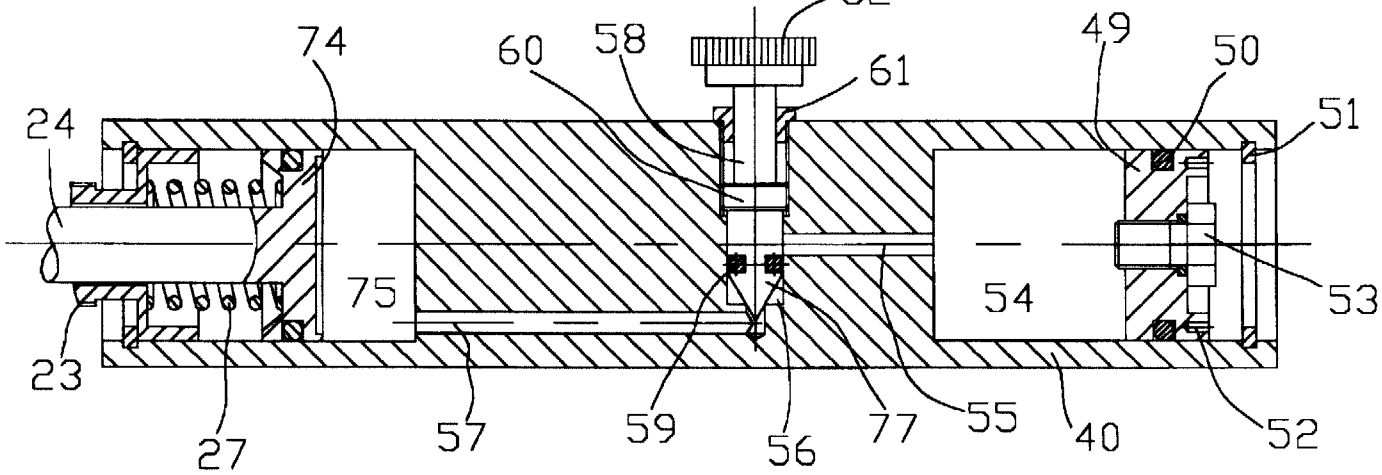
FIG. 4 is a fragmentary section 4—4 view of the hand tool push connect flaring apparatus as shown in FIG. 2, illustrating the pressure relief valve operation, in a closed valve position.
Figure 5:
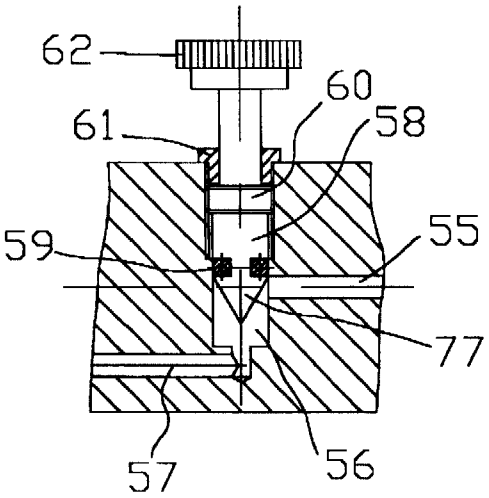
FIG. 5 is a fragmentary section 4—4 view of the hand tool push connect flaring apparatus as shown in FIG. 2, illustrating the open valve position.

Once the flaring process is completed the flared tube 11 is retrieved by releasing pressure in region 75 through a relief valve as shown in FIGS. 4 and 5. The pressure in region 75 is released when valve nub 62 is turned counter clockwise. Oil reservoir 54 is also connected to the region 75 through a separate return passages 57, 56 and 55 that are located in a plane perpendicular to the plane of intake passages 32, 33 and 34. The pressure relieve valve unit consists of knob 62, valve stem 58, O-ring 59 and cap screw 61. Valve stem 58 has thread 60 in its mid section. Cylindrical passage 56 has internal thread 78. Valve stem 58 is screwed into threads 78 of passage 56. Cap screw 61 guides valve stem 58 in the axial movement and prevents the stem from being unscrewed out of passage 59. To close the valve, nub 62 is turned clockwise thereby bringing stem 58 down into passage 56. The fully closed valve position is shown in FIG. 4 wherein conical tip 77 of valve stem 58 is seated on the circular opening of the passage 57. In this position, oil can only flow from reservoir 54 to 75 through one way passages 32, 33 and 34. To open the valve, nub 62 is turned counter clockwise thereby bringing stem 58 upwardly out of the opening of passage 56. The open position of the valve is shown in FIG.5 where conical tip 77 is separated from the circular opening of passage 57, thus connecting passages 57, 56 and 55. In the open position the oil pressure of 75 is released by directing the oil back to reservoir 54 through passages 57, 56 and 55.

Figures 6A, 6B:
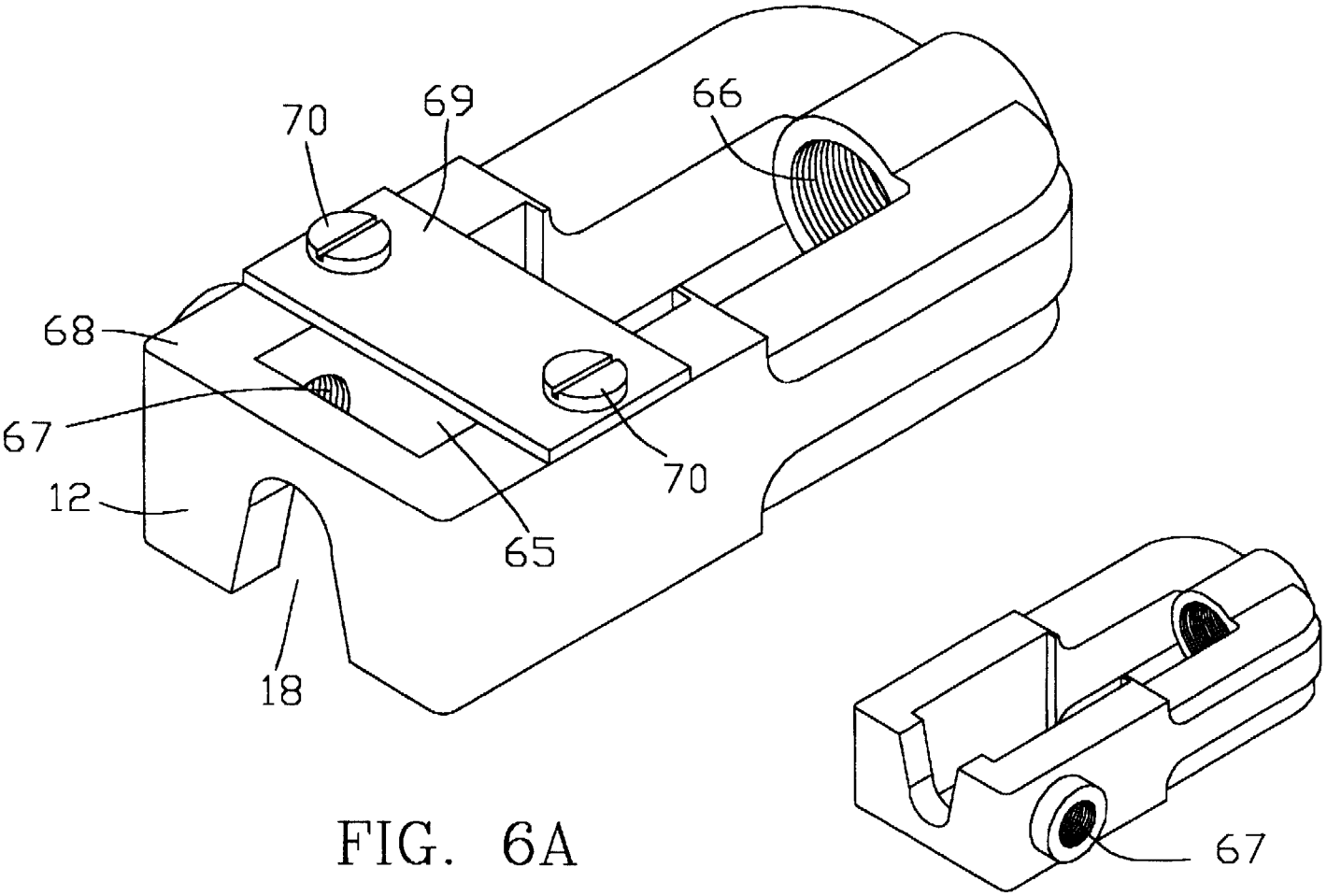
FIG. 6*a* is a perspective view of a yoke of the hand tool push connect flaring apparatus as shown in FIG. 1, illustrating the back plate.
FIG. 6*b* is a perspective view of a yoke of the hand tool push connect flaring apparatus as shown in FIG. 1, illustrating the vise screw.

As shown in FIG. 6*a* and FIG.6*b*, yoke 12 has internally threaded portion 66 that engages with the positioning screw 23, body 68 that secures a gripper assembly, opening 18 for the tube to extend outward and internal threads 67 for the vise screw. The gripper assembly is also supported by back plate 69 that is attached to yoke 12 by two screws 70.

Figure 7:
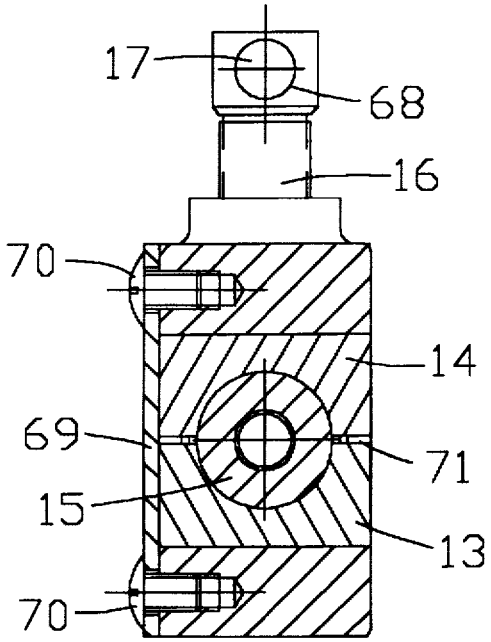
FIG. 7 is a cross-section 7—7 view of the hand tool push connect flaring apparatus as shown in FIG. 1, illustrating the positioning of the tube between the gripper-dies and the back plate.

Internal surfaces 72 of gripper-dies 13 and 14 are threaded, as shown in FIG. 2. The inner diameter of 72 is less than the outer diameter of tube 11 so that when tube 11 is assembled within I 5 the gripper-dies, gap 71 exists between the two gripper-dies 13–14, as shown in FIG. 7. Gap 71 is necessary for firmly gripping tube 11, that is rigidly keeping the tube in its position while the flaring process proceeds.

Figure 8:
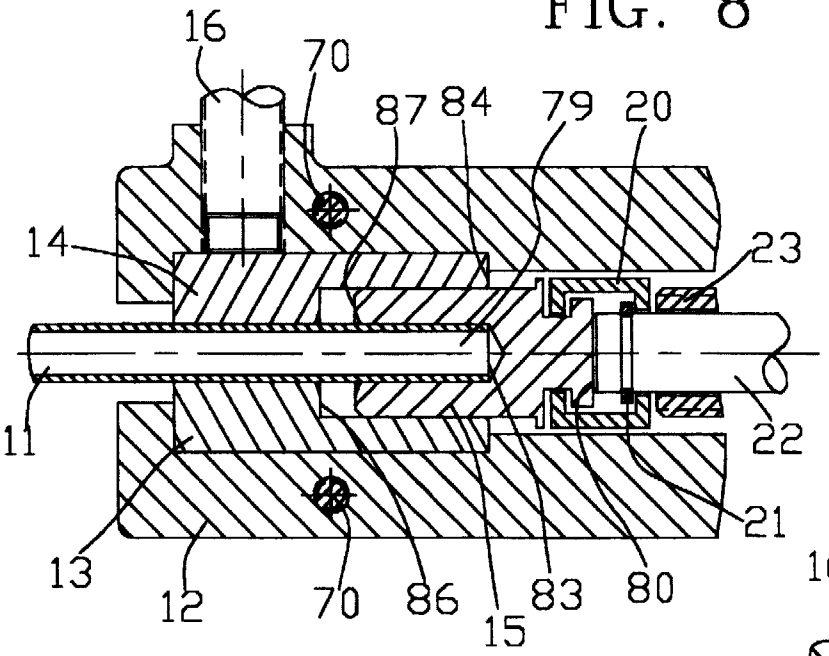
FIG. 8 is an enlarged fragmentary section 4—4 view of the hand tool push connect flaring apparatus as shown in FIG. 1, illustrating the initial positions of the tube, the gripper-die, the adapter-die and the flaring piston with respect to one another.

Adapter-die 15 is a crucial element in the flaring process since its dimension varies for different sizes of tube 11. As shown in FIG. 8, the frontal end of adapter-die 15 has a cylindrical hole 79 into which tube 11 is inserted in. The rear end of adapter-die 15 is placed into and is secured by guide nut 20. While the frontal end of the alternative design of adapter-die 93 is the same as primary design 15 for specific tube size, its rear end has screw threads 95 that is screwed into the alternative design of guide nut 96. The turning and tightening of 93 and 96 are facilitated by rough etched knurled surface 94 on alternative adapter-die 93 and on the outer surface of 96, as shown in FIG. 2*b*.

The initial relative positioning of tube 11 with respect gripper-dies 13 and 14 plays an important role in achieving proper push connect flaring. Before the flaring process, as shown in FIG. 8, tube 11 is placed between the two gripper-dies 13 and 14 such that distal end 83 of tube 11 is in the same plane as end plane 84 of the gripper-dies. The depth of cylindrical hole 79 of adapter-die 15 is such that just before the tube deformation the distal end of tube 11 is completely placed inside cylindrical hole 79. Also, the rear end of 15 is in contact with the distal end of piston 22. In addition, to allow a space for the flared portion of tube 11, the distance between surfaces 85 and 84 is smaller than that of 86 and 87.

Figure 9:
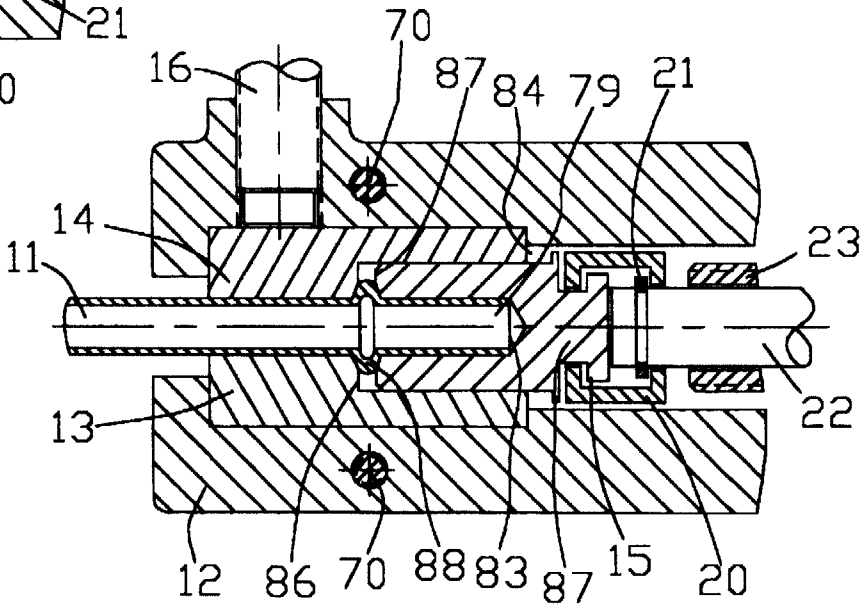
FIG. 9 is an enlarged fragmentary section 4—4 view of the hand tool push connect flaring apparatus as shown in FIG. 8, illustrating the final, flared, positions of the tube, the gripper-die, the adapter-die and the flaring piston with respect to one another.

In the process of flaring, piston 22 applies axial force to the adapter-die 15 which in turns applies axial force to tube 11. Since the distal end of tube 11 is restrained by cylindrical hole 79 and tube 11 is also rigidly attached to gripper-dies 13 and 14, therefore, tube 11 is confined and deforms within its unrestrained length, that is, the distance between surfaces 86 and 87, as shown in FIG. 9. Once adapter-die 15 starts to move axially closer to the gripper-dies the flaring process is started. The flaring process is completed and push connect flare 88 is formed when surface 84 of the gripper-dies and step 85 of the adapter-die come in contact.

The relative positions of surfaces 84, 85, 86 and 87 with respect to one another varies by the outer diameter, wall thickness and material deformability of tube 11. That is, the sizes and materials of tube 11 constitute the geometric dimensions of adapter-die 15 and gripper-dies 13 and 14.

Operation

To begin the operation of push connect flaring apparatus 10, as shown in FIG. 1, proper size gripper-dies 13 and 14 and adapter-die 15 are selected. Then the relief valve nub 62 is turned counter clockwise to fully recess flaring piston 22 to its initial position. The relief valve nub 62 is then closed. Yoke 12 is turned counter clockwise using one hand while holding hydraulic pump 40 with the other hand. The turning moves yoke 12 along the longitudinal axis of positioning screw 23 away from pump 40 thereby creating space within yoke 12 for insertion of gripper-dies 13 and 14 and adapter-die 15. Unscrew vise 16 by turning tightening bar 17 counter clockwise. Then, insert adapter-die 15 into the open side of guide nut 20, as shown in FIG. 2*a*. In the alternative adapter design, use adapter-die 93 and screw its end into guide nut 96 and secure the adapter and the nut by tightening the screw. Then, tube 11 is assembled between gripper-dies 13 and 14 such that distal end 83 of tube 11 is in the same plane as end plane 84 of the gripper-dies. While holding tube 11 and gripper-dies 13 and 14 together, the assembly is placed inside space 65 of yoke 12. The assembly is rigidly connected to yoke 12 by turning tightening bar 17 clockwise, which presses screw 16 against gripper-die 14 and yoke 12 against gripper-die 13. At this position the jaws of gripper-dies 13 and 14 apply a compressive load on tube 11 and secure its position with respect to yoke 12. Finally, pump body 40 is turned clockwise so that the distal end of tube 11 enters into cylindrical hole 79 of adapter-die 15. The clockwise rotation of pump 40 moves the yoke along the axial direction of positioning screw 23 and closer to pump 40. The turning is continued so that distal end 83 of tube 11 is completely inside cylindrical hole 79 of adapter-die fixture 15, as shown in FIG. 8. At this time, for further movement of adapter-die 15 into gripper-dies 13 and 14 hydraulic pump 40 is used. To pump the oil lever arm 42 is pressed down towards pump 40 repeatedly which hydraulically energizes flaring piston 22 and deforms tube 11 into a radially outward convex position, as shown in FIG. 9. The pumping is continued until surface 85 of adapter-die 15 reaches surface 84 of the gripper-dies 13 and 14.

To retrieve the deformed tube 11, the oil pressure is released by opening the relief valve 62, that is, turning nub 62 counter clockwise. Then, pump body 40 is turned counter clockwise until adapter-die 15 is separated from the distal end of tube 11. Remove the adapter-die either by moving out 15 from 20 or in the case of the alternative design unscrew 93 from 96. Then unscrew tightening bar 17 by turning the bar counter clockwise and release the gripper-die assembly. Finally the tube is retrieved. The flaring process for different tube sizes require changing gripper-dies 13 and 14 and adapter-die 15.

While the invention has been explained by a detailed description of certain specific embodiments, it is understood that various modifications and substitutions can be made in any of them within the scope of the appended claims which are intended also to include equivalents of such embodiments.

What is claimed, is:

1. A hand tool tube push connect flaring apparatus for forming a radially outwardly convex extending, push connect flare close to, but not on, a distal end of a hollow malleable cylindrical tubing comprising:

gripper-die means for holding said tube;

a yoke member for securing said gripper-die means, said yoke member having a base with internal thread means at its base;

a hollow, cylindrical, externally threaded positioning screw member for engaging to the internal threads of said yoke;

a manual hydraulic pump apparatus rigidly connected to said positioning screw member, said hydraulic pump apparatus having a flaring piston comprising an elongated cylindrical rod axially extending outwardly from the pump, said flaring piston passing through the hollow space of said positioning screw member, said hydraulic pump apparatus having a lever arm for pumping fluid;

a guide nut member and a snap ring member, said guide nut member being loosely connected to said flaring piston by the snap ring member; and, an adapter-die member for pressing said tube in the axial direction of the tube, wherein said adapter-die member is secured by said guide nut, and is connected to said flaring piston.

2. The hand tool apparatus of claim 1 wherein the gripper-die means comprises:

two jaw means each having a half cylindrical internally threaded cavity for rigidly gripping said tube, said jaw means each having a larger half cylindrical cavity for placing said adapter-die member within the gripper-die means and having a space for a flared tube.

3. The hand tool apparatus of claim 1 wherein the yoke member further comprises a U- Shaped frame that is-closed at its top creating a closed frame to secure said gripper-die means;

back plate means that is rigidly attached to said frame by fastening means to support said gripper-die means;

means for supporting said gripper-die means within said yoke; and, vise means mounted within one side of said frame having a screw member and a tightening bar member for rotating said screw member and moving the screw through the frame, said screw member means and said tightening bar member securing said gripper-die means to said yoke.

4. The hand tool apparatus of claim 3 wherein the guide nut member comprises a cubical frame having one side open, said frame having a circular hole on the side adjacent to the open side to connect to said flaring piston, said frame also having a U-Shaped cut on the side opposite to the side that has the circular hole for supporting said adapter-die, and said guide nut is loosely connected to said flaring piston by a snap ring and is located between the two legs of the U-Shaped frame of said yoke.

5. The hand tool apparatus of claim 2 wherein the adapter-die member comprises:

a tubular body in the frontal end of said adapter die member having an internal cylindrical hole, said hole having an internal diameter equal to the size of said tube, and a depth of less than the depth of the large cylindrical cavity of said jaw means;

a circular notch at the rear end of said adapter having a rectangular cross-section at its rear end, said adapter-die being loosely connected to said guide nut by placing said circular notch within the U-Shaped cut of said guide nut, said guide nut securing said adapter to said flaring piston.

6. The hand tool apparatus of claim 1 wherein the hydraulic pump means comprises:

a cylindrical frame having an oil reservoir cylinder in the rear end of said frame, and a pressurized cylinder in the front end of said frame;

a positioning screw means comprising a hollow elongated tube and having a flat circular plate at its rear end, said hollow tube having threads on its outer surface and said circular plate is rigidly connected to said cylindrical frame by set screw means;

a piston mean for said oil reservoir cylinder having an O-ring to seal the oil and a cap screw means for feeding or draining the oil from said reservoir;

flaring piston means having an elongated cylindrical bar in its frontal end and a flat piston means at its rear end, said elongated bar passing through said positioning screw and having a circular notch at its tip for a snap ring and said flat piston means having an O-ring to seal the oil;

passage means comprising a set of long circular holes inside said frame, said passage means connecting said oil reservoir to the pressurized cylinder and one way valve means in said passage means having a set screw, a bias spring and a spherical ball, said spring applies a bias force to said ball to close an opening of said passage means and said spring force is adjusted by said set screw;

pumping linkage means further comprising:

a piston member for pressurizing the oil to push away said ball from the opening of said passages thereby allowing the oil to flow to said pressurized cylinder;

a lever arm member that is connected to a linkage means and said piston by pin members, said lever arm and said linkage means being rigidly connected to said pump frame through a support bracket means and screw means;

a spring member for applying a bias force to said lever arm member to separate it from said frame; and, a relief valve means comprising returned oil passage means comprising cylindrical holes within said frame that connect said oil reservoir to said pressurized reservoir, said return oil passage means being different from that of said passage means having said one way valve means, and a portion of said returned oil passage has internal threads; and, a cylindrical valve stem means having a nub member at one end for turning the valve, an O-ring means, a threaded body and a conical tip member, said threaded body being engaged with said threaded passage such that by turning the nub means counter clockwise moves the stem and the conical tip member away from an opening of said passage thereby permitting oil flow from said pressurized cylinder to said reservoir cylinder, and conversely, turning the nub clockwise causes the stem and the conical tip to move toward the opening of the passage and finally closes said passage.

7. The hand tool apparatus of claim 4 wherein the guide nut comprises a short tubular frame having one side closed, the closed side having a circular hole that connects to said flaring piston by said snap ring, and having an internally threaded surface for securing an altered adapter-die means.

8. The hand tool apparatus of claim 1 is portable, light weight, maneuverable and is easy to use for creating a push connect flare away from the distal end of said tube.

9. The hand tool apparatus of claim 1 wherein a plurality of gripper-dies and adapter-dies are provided with their sizes and relative positions varying by the outer diameter, the wall thickness and the material deformability of said tube.

10. The hand tool apparatus of claim 1 wherein, adapter-die and gripper-die means are provided so that single, double or a bubble flaring at the distal end of the tube may be created.

11. The hand tool of claim 1 wherein:

the adapter-die includes a tubular front end and a rear end having an externally threaded edge that is engageable with the guide nut, said guide nut having an internal thread for connecting to the flaring piston of the pump apparatus.

* * * * *